US008671851B1

(12) United States Patent
Minervini

(10) Patent No.: US 8,671,851 B1
(45) Date of Patent: Mar. 18, 2014

(54) STAND-SIT CONVERTIBLE WORKSTATION AND METHODS ASSOCIATED THEREWITH

(76) Inventor: Patrick Minervini, Littleton, CO (US)

( * ) Notice: Subject to any disclaimer, the term of this patent is extended or adjusted under 35 U.S.C. 154(b) by 0 days.

(21) Appl. No.: 13/488,955

(22) Filed: Jun. 5, 2012

Related U.S. Application Data

(60) Provisional application No. 61/493,875, filed on Jun. 6, 2011.

(51) Int. Cl.
*A47B 1/04* (2006.01)

(52) U.S. Cl.
USPC ..... 108/79

(58) Field of Classification Search
USPC ..... 108/77–79, 115, 144.11; 312/194, 195
See application file for complete search history.

(56) References Cited

U.S. PATENT DOCUMENTS 387,760 A * 8/1888 Brack ..... 312/228
407,908 A * 7/1889 Stockman ..... 108/79
825,854 A * 7/1906 Mead ..... 108/79
943,236 A * 12/1909 Campbell ..... 108/115
1,424,419 A * 8/1922 Malarkey ..... 108/79
2,039,482 A * 5/1936 Groves ..... 108/63
2,154,125 A * 4/1939 Dillon ..... 108/79
2,563,891 A * 8/1951 Wallance ..... 108/79
2,808,305 A * 10/1957 Jackson ..... 312/140.2
3,456,600 A * 7/1969 Oscoz Sanchez ..... 108/33
3,565,501 A * 2/1971 Bowen ..... 312/228
3,644,011 A * 2/1972 MacDonald ..... 312/258
4,943,041 A * 7/1990 Romein ..... 5/620
5,676,062 A * 10/1997 Lloyd ..... 108/36
5,967,055 A * 10/1999 Schumacher ..... 108/50.11
6,494,147 B1 * 12/2002 Schulte et al. ..... 108/34
6,997,115 B2 * 2/2006 Lockwood et al. ..... 108/115
7,299,753 B2 * 11/2007 Strong ..... 108/115
2003/0019404 A1 * 1/2003 Liu ..... 108/77
2009/0078173 A1 * 3/2009 Topham et al. ..... 108/77

* cited by examiner

*Primary Examiner* — Matthew Ing
(74) *Attorney, Agent, or Firm* — Fox Rothschild LLP

(57) ABSTRACT

A convertible workstation includes a plurality of members and adjustable features to enable an operator of the convertible workstation to transition the convertible workstation from a sitting workstation to a standing workstation.

8 Claims, 12 Drawing Sheets

Top View

Front View

Side View

STAND-SIT CONVERTIBLE WORKSTATION AND METHODS ASSOCIATED THEREWITH

CROSS-REFERENCE TO RELATED APPLICATION

The present application claims the benefit of U.S. Provisional Patent Application No. 61/493,875 filed on Jun. 6, 2011, the content of which is incorporated herein by reference in its entirety.

FIELD

The present invention is related to convertible workstation furniture.

BACKGROUND

Medical research has identified that extended periods of sitting, such as when a person works at an office desk, are a major risk to good health. That is, regardless of the amount of daily exercise a person undertakes, extended sitting is now being related to negative health consequences.

Existing standing workstations typically do not function with an existing work station or desk surface. In addition, they utilize complex mechanisms with a configuration that does not integrate storage both above and below a primary work surface. Such workstations are not modular in design and they are not adapted to activities other than principally for computer work. Accordingly, there is a need for additional devices, systems and/or methods that address one or more of the problems or shortcomings noted above.

SUMMARY

It is to be understood that the present invention includes a variety of different versions or embodiments, and this Summary is not meant to be limiting or all-inclusive. This Summary provides some general descriptions of some of the embodiments, but may also include some more specific descriptions of other embodiments.

At least one embodiment of the present invention relates to providing a convertible workstation that enables an operator of the convertible workstation to transition the convertible workstation from a sitting workstation to a standing workstation. More particularly, crafts/hobbies, reading, writing, computer work and the like can be accomplished either in a seated position or in a standing position simply by changing the work surface using the convertible workstation.

At least one embodiment of the present invention has a plurality of positions of adjustment corresponding user height differentials, thereby providing anatomically efficient standing positions. The convertible workstation can be used on a desk in an office, at a home desk or at another type of work surface.

At least one embodiment of the present invention incorporates storage capabilities, side extensions and two interchangeable positions. At least one embodiment of the convertible workstation includes a configuration that folds in on itself and thus allows access to the work surface in a seated fashion, and then when converted to an extended-open position, the convertible workstation forms a standing workstation.

At least one embodiment of the one or more present inventions pertain to a method of providing a height adjustable workstation. Accordingly, a method of providing a height adjustable workstation at an existing work surface is provided, comprising;

placing an assembly of panel members on the existing work surface, the assembly of panel members including a first horizontal panel interconnected to at least one pivotable support for supporting a drop leaf panel;

rotating the drop leaf panel to a substantially horizontal orientation; and pivoting the at least one pivotable support under the drop leaf panel.

In at least one embodiment, the method further comprises adjusting a height of the first horizontal panel. In at least one embodiment, the method further comprises adjusting a height of the at least one pivotable support.

Various components are referred to herein as "operably associated." As used herein, "operably associated" refers to components that are linked together in operable fashion, and encompasses embodiments in which components are linked directly, as well as embodiments in which additional components are placed between the two linked components.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments of the present inventions are set forth in the attached figures and in the Detailed Description as provided herein and as embodied by the claims. It should be understood, however, that this Summary does not contain all of the aspects and embodiments of the one or more present inventions, is not meant to be limiting or restrictive in any manner, and that the invention(s) as disclosed herein is/are understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

To further clarify the above and other advantages and features of the one or more present inventions, a more particular description of the one or more present inventions is rendered by reference to specific embodiments thereof which are illustrated in the appended drawings. It should be appreciated that these drawings depict only typical embodiments of the one or more present inventions and are therefore not to be considered limiting of its scope. The one or more present inventions are described and explained with additional specificity and detail through the use of the accompanying drawings in which.

Figure 1:
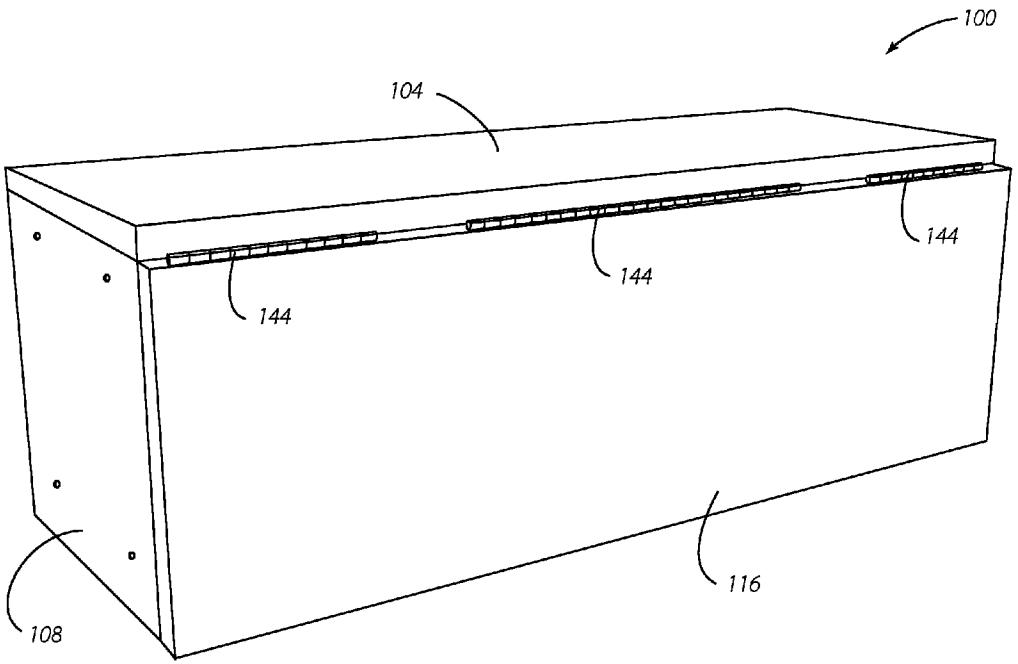
FIG. 1 is a perspective view of one embodiment of the present invention illustrated in a closed position.

The drawings are not necessarily to scale.

DETAILED DESCRIPTION

One or more embodiments of the one or more inventions described herein include a convertible workstation that enables an operator of the convertible workstation to transition the convertible workstation from a sitting workstation to a standing workstation. A plurality of vertical height positions are possible to accommodate people of different height.

Convertible Workstation

Referring now to FIGS. 1-5C, an embodiment of a convertible workstation 100 is shown. The convertible workstation 100 includes a plurality of panel members, including a horizontal panel 104, a first lateral panel 108, a second lateral panel 112, a drop leaf panel 116, a first leaf support panel 120, a first leaf support extension 124, a second leaf support panel 128, a second leaf support extension 132, a first horizontal panel riser 136 and a second horizontal panel riser 140. The drop leaf panel 116 is interconnected to horizontal panel 104 by one or more hinges 144 to allow the drop leaf panel 116 the ability to move alternately between its vertical position (see FIG. 1) and its horizontal position (see FIG. 2A). A rear stabilizer, such as a rear panel 148, connects the horizontal panel 104 to the first and second lateral panels 108, 112.

Figure 2A:
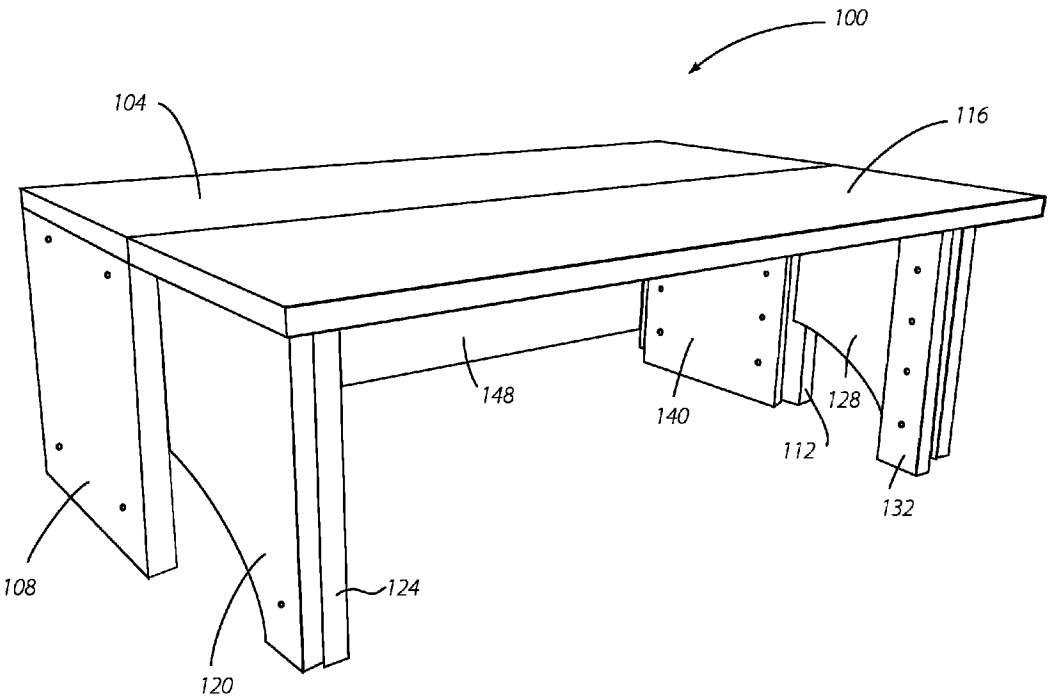
FIG. 2A is a perspective view of the device of FIG. 1 illustrated in an open position.
Figure 2B:
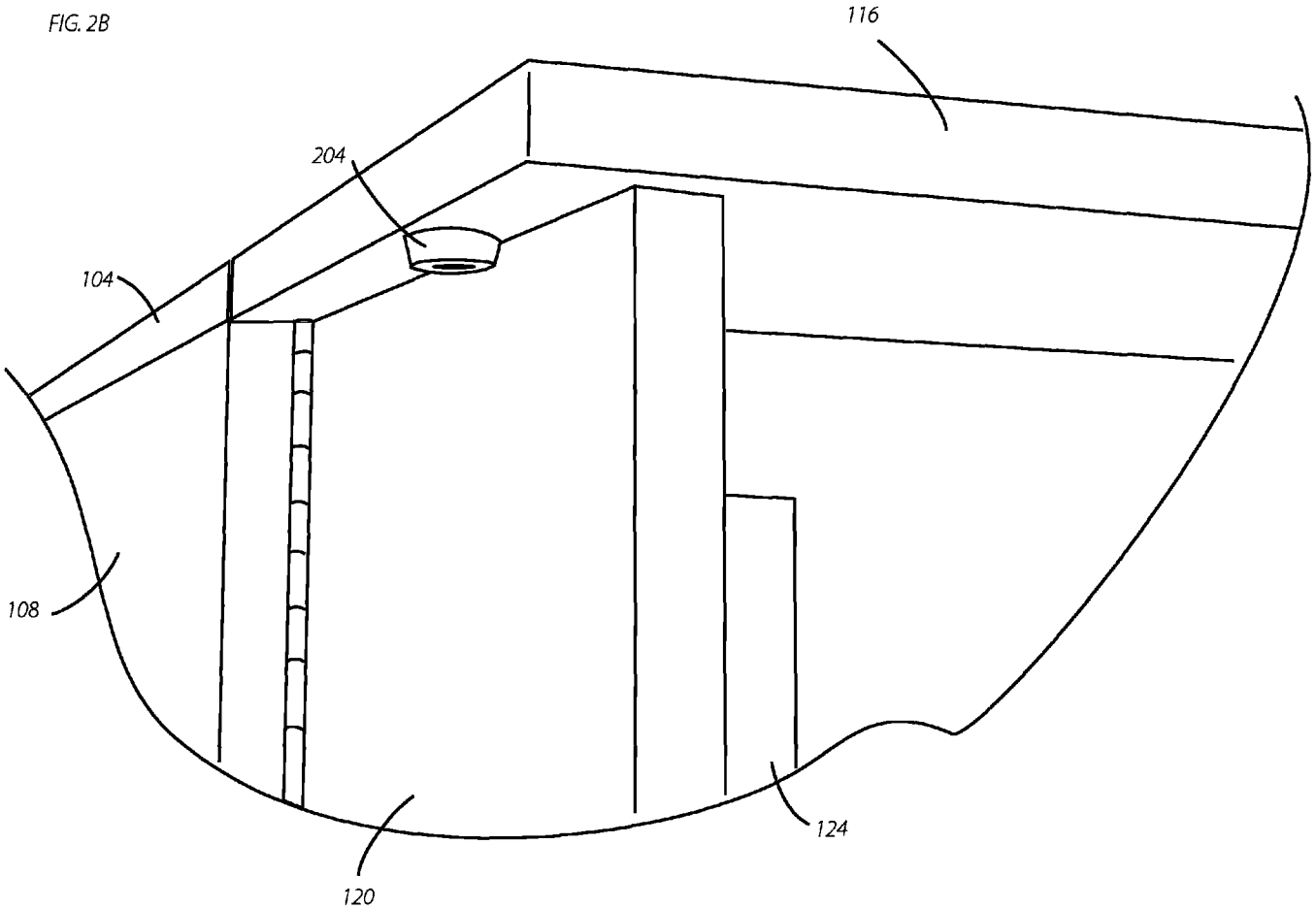
FIG. 2B is an underside detail view of a portion of the device shown in FIG. 2A.

Referring now to FIG. 2A, the convertible workstation 100 is shown with the drop leaf panel 116 located in its raised or horizontal position. This is accomplished by first raising the drop leaf panel 116 from its vertical position to its horizontal position. Next, first leaf support panel 120 and second leaf support panel 128 are pivoted by way of support panel hinges 300 forward to stop bumpers 204, as best seen in FIG. 2B. The first and second leaf support panels 120, 128 function to maintain the drop leaf panel 116 it its horizontal position.

Figure 2C:
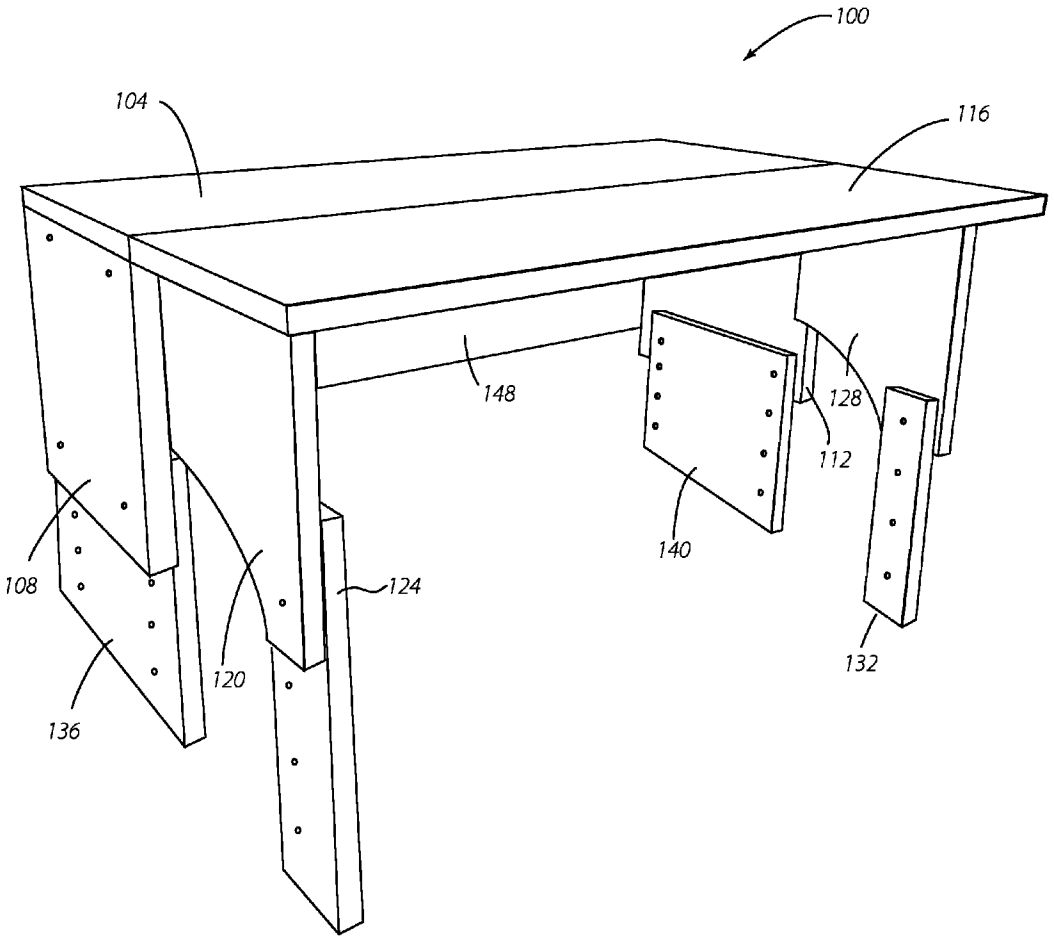
FIG. 2C is a perspective view of the device of FIG. 2A illustrated in an elevated position.

As seen in FIG. 2A, the convertible workstation 100 is depicted at the lowest height. When placed on a desk surface 28"-29" in height, as shown in FIG. 2A, this will position a user of 5'-5'5" with bend at the elbows within a comfortable anatomic range while standing. Advantageously, the convertible workstation 100 includes a plurality of height-adjustable positions that enable the convertible workstation 100 to be configured to the particular needs of a person using the convertible workstation 100. More particularly, in position two, the convertible workstation 100 will position a user of 5'6"-5'10" with bend at the elbows within a comfortable anatomic standing range when placed on a surface of 28"-29". In position three, the convertible workstation 100 will position a user of 5'11"-6'1" with bend at the elbows within a comfortable anatomic standing range when placed on a surface of 28-29". In position four, the convertible workstation 100 will position a user of 6'2"-6'6" with bend at the elbows within a comfortable anatomic standing range when placed on a surface of 28"-29". In position five, the convertible workstation 100 will position a user of 6'7" plus with bend at the elbows within a comfortable anatomic standing range and when placed on a surface of 28"-29". FIG. 2C illustrates the convertible workstation 100 in a vertically extended position.

To collapse the convertible workstation 100 back on itself, first leaf support panel 120 and second leaf support panel 128 are pivoted back under the horizontal panel 104 and the drop leaf panel 116 is allowed to return to the close vertical position as seen in FIG. 1.

Figure 3:
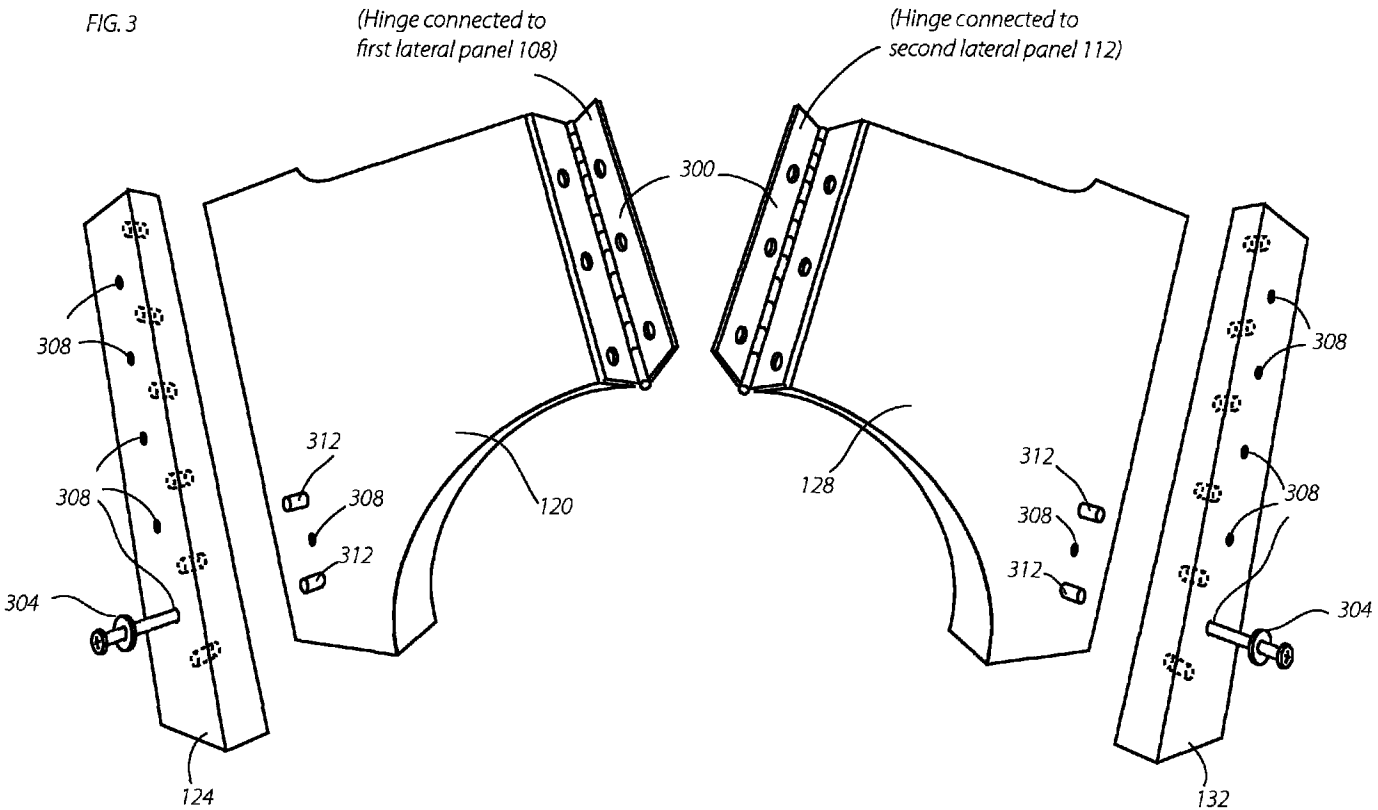
FIG. 3 illustrates an embodiment of a drop-leaf support pin and bolt system that facilities height adjustability at fixed increments.

With further reference to FIG. 3, the height adjustment system is illustrated. More particularly, in at least one embodiment the convertible workstation 100 can be adjusted to at least one alternative height. By way of example and not limitation, the convertible workstation 100 depicted in FIGS. 1-5C can be adjusted to five alternate heights. A rod, peg, screw, nail or machine bolt or other alternative locking device 304 can be inserted into the pre-set holes 308 in the first leaf support panel 120 and the first leaf support extension 124, as well as the second leaf support panel 128 and the second leaf support extension 132, while the two adjacent pins 312 index and align the height-adjustable first leaf support panel 120 and the first leaf support extension 124, as well as the second leaf support panel 128 and the second leaf support extension 132. As previously noted, FIG. 2C illustrates the convertible workstation 100 in a vertically extended position.

Figure 4B:
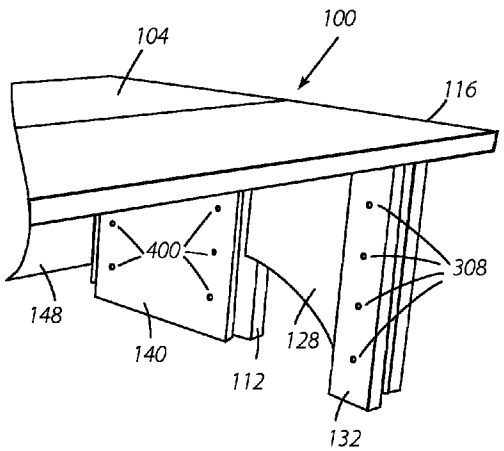
FIGS. 4A and 4B are perspective details of both left and right side assemblies.
Figure 4A:
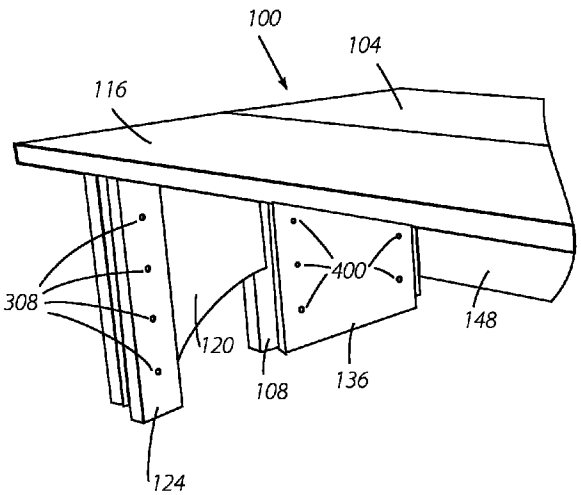

Referring now to FIGS. 4A and 4B, the first horizontal panel riser 136 and the second horizontal panel riser 140 include a plurality of pre-set holes 400 drilled to align with the pivoting adjusters, that is, the first leaf support panel 120 and the first leaf support extension 124, as well as the second leaf support panel 128 and the second leaf support extension 132, thereby allowing the horizontal panel 104 to be adjusted in height to correspond to the height of the drop leaf panel 116. Two rods, pegs, screws, nails or machine bolts or other alternative locking devices 304 can be inserted into the pre-set holes 400.

Figure 5A:
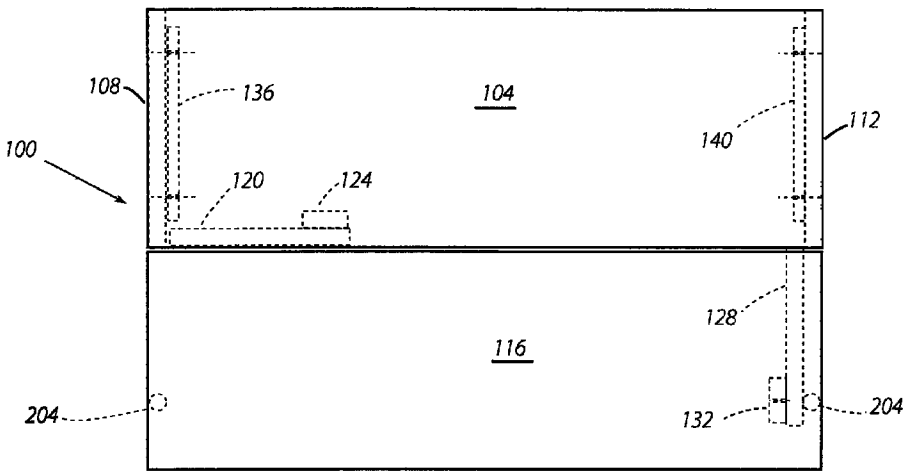
FIGS. 5A-5C are top, front and side views, respectively, of the convertible workstation.
Figure 5B:
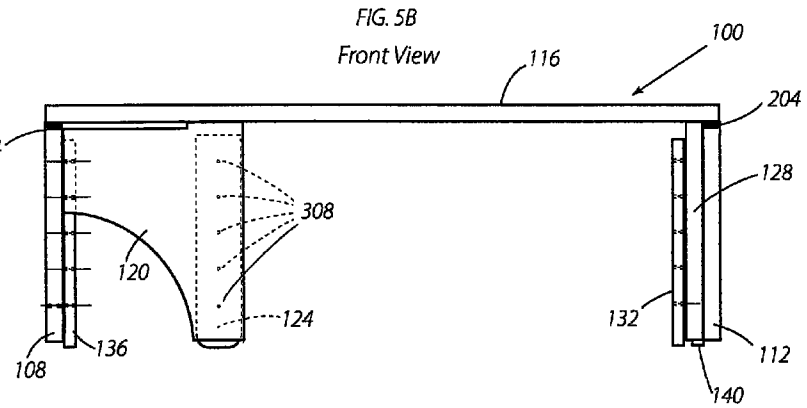
Figure 5C:
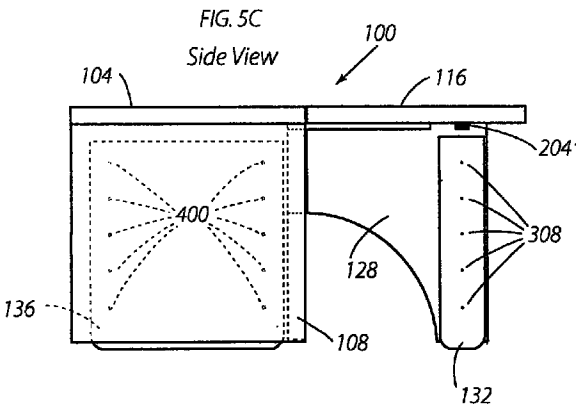

Referring to FIGS. 5A-5C, top, front and side views of the convertible workstation 100 are shown with the first leaf support panel 120 and the first leaf support extension 124 in the retracted position, and the second leaf support panel 128 and the second leaf support extension 132 in the forward position supporting drop leaf panel 116.

Figure 6A:
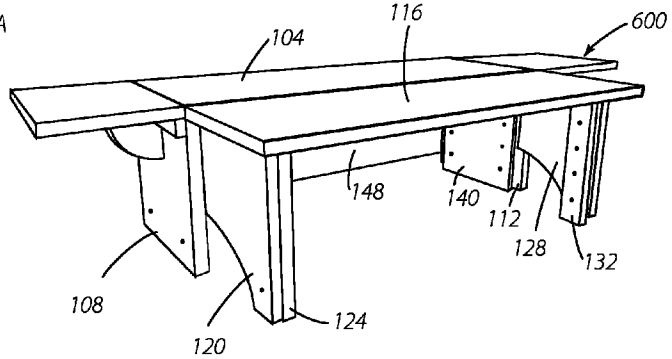
FIGS. 6A and 6B are perspective views of the rear surface side extensions that can be added to one or both sides to increase the surface area of the convertible workstation.
Figure 6B:
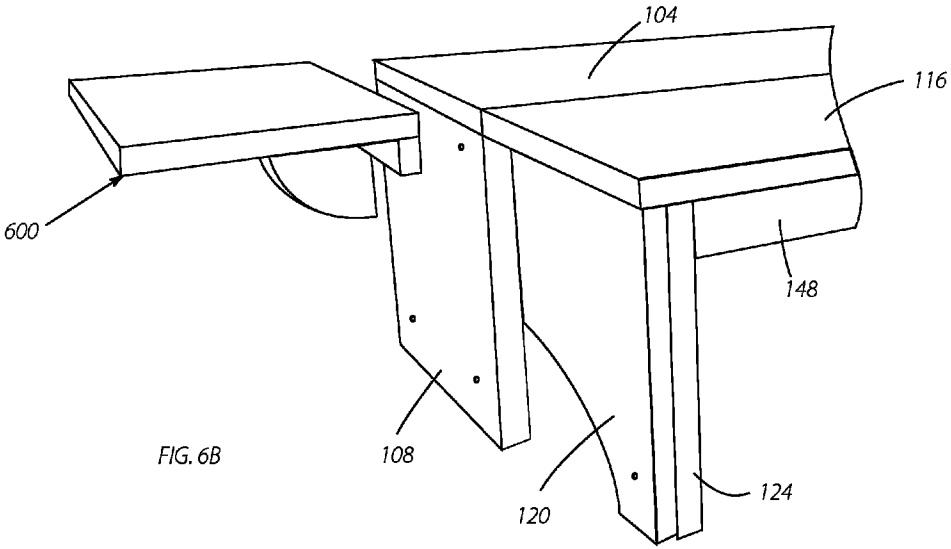

Referring to FIGS. 6A and 6B, in at least one embodiment side extensions 600 can be added to the convertible workstation 100 on one or both sides to increase the elevated work surface of the rear area of the workstation. In at least one embodiment, two machine screws are inserted through present holes to connect the attachment.

Figure 7:
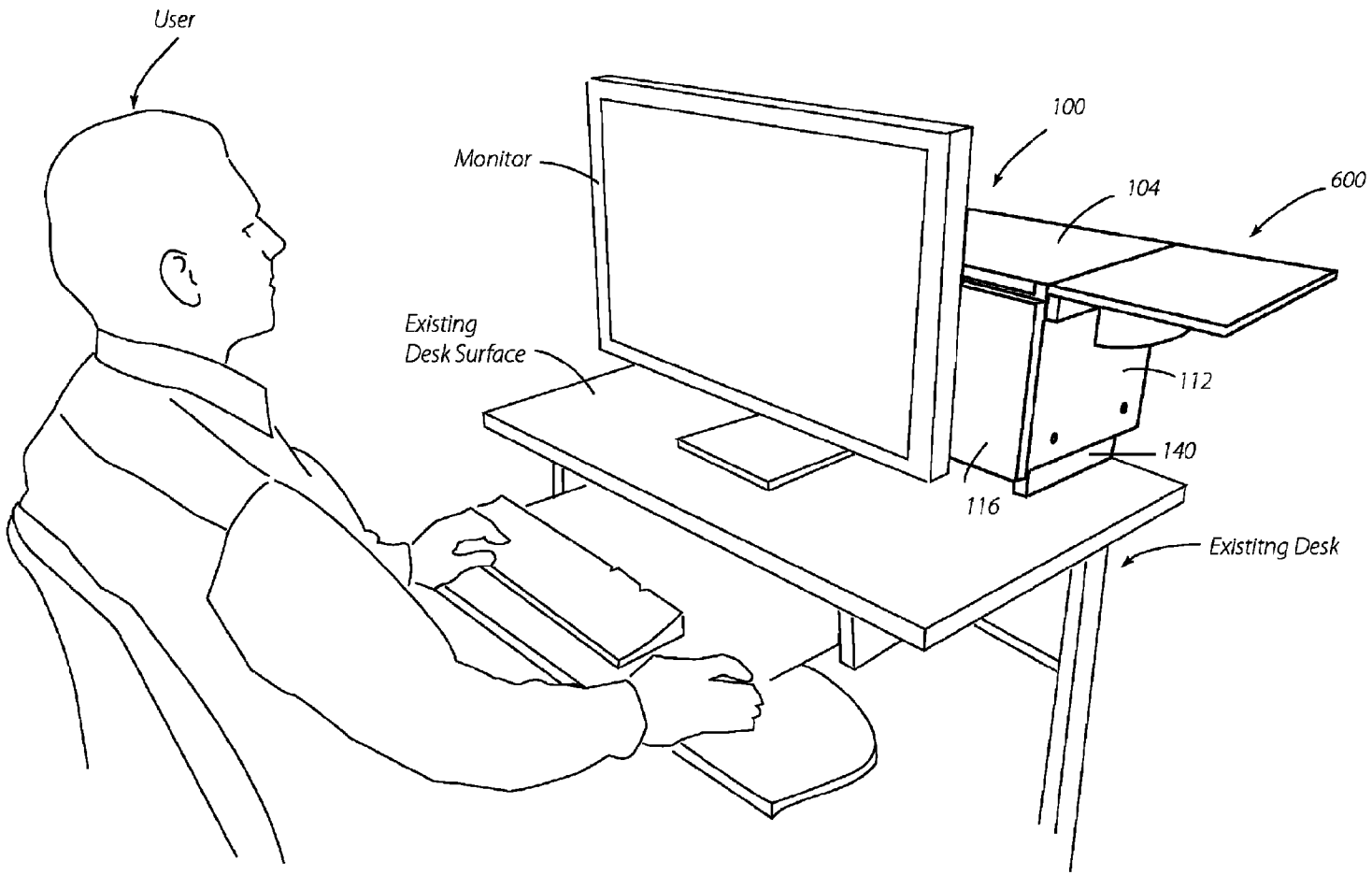
FIG. 7 is a perspective view of an embodiment of a convertible workstation residing on an existing desk surface with a user viewing a monitor in front of the convertible workstation.

Referring now to FIG. 7, a user of an existing desk is shown sitting adjacent the existing desk viewing a monitor that resides on the existing desk surface. The convertible workstation 100 also sits on the existing desk surface and is configured for the user to reside in a sitting position when at the existing desk and convertible workstation 100. For the arrangement shown in FIG. 7, positioned behind the monitor is the convertible workstation 100 configured in its first or closed position. More particularly, the drop leaf panel 116 is oriented in a substantially vertical orientation. Storage space resides behind the drop leaf panel 116 and below the horizontal panel 104.

Figure 8:
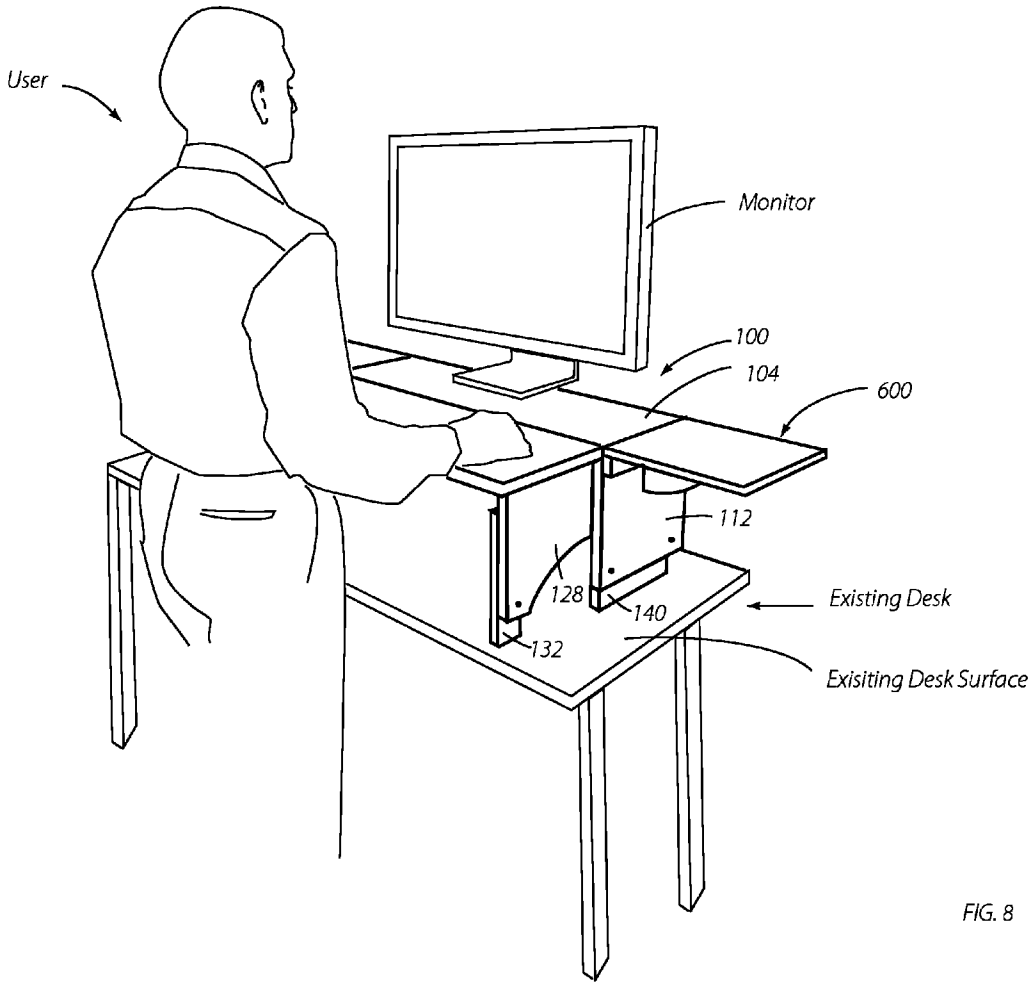
FIG. 8 is a perspective view of the embodiment of the convertible workstation shown in FIG. 7, wherein the user is viewing the monitor that is now situated on the convertible workstation.

Referring now to FIG. 8, the user is shown standing at the existing desk and viewing the monitor that is now positioned on the horizontal panel 104 of the convertible workstation 100. To achieve this open or second position of the convertible workstation 100, the user lifts the monitor from the existing desk surface and places it on the horizontal panel 104 of the convertible workstation 100. The user then moves the first and second leaf support panels 120, 128 forward to support the drop leaf panel 116 in its horizontal position. The drop leaf panel 116 may then act as a working surface, such as for a keyboard and/or a computer mouse. It is to be understood that the convertible workstation 100 may be used for a variety of purposes that do not involve a computer or a monitor. Accordingly, use of the convertible workstation with a monitor as shown in FIGS. 7 and 8 is for illustration purposes only.

Figure 9A:
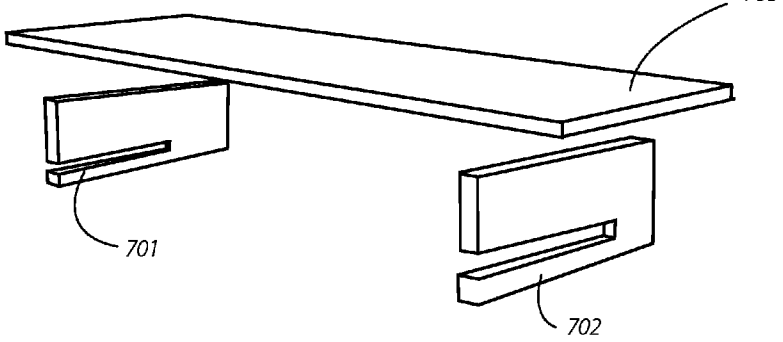
FIG. 9A is a perspective view of the individual parts of an embodiment of a screen riser accessory.
Figure 9B:
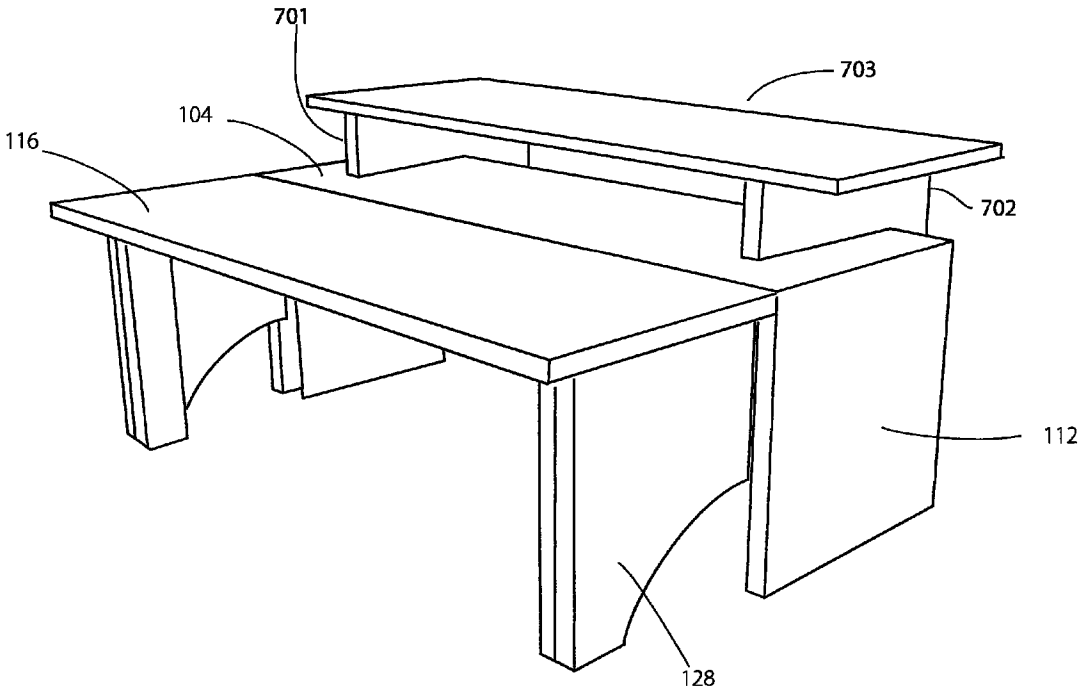
FIG. 9B is a perspective view of the workstation with the screen riser accessory attached to the base unit.

Referring now to FIGS. 9A and 9B, and in accordance with at least one embodiment, an optional screen riser accessory is illustrated. By way of example and not limitation, the screen riser accessory provides 4" of offset in height from the hand position and an additional 3" to the rear of the workstation. By raising the height of a monitor, an improvement is obtained for some users because of the biomechanical relationship of the user's line of sight to the screen in conjunction with the user's hand position. The area under the screen riser provides a location to slide the keyboard and mouse, thereby quickly freeing a clear elevated hard surface for writing and reviewing papers etc. while standing. Attachment to the horizontal panel 104 of the workstation from the rear is provided by way of a first rail or support member 701 and a second slotted rail or support member 702. Horizontal screen riser member 703 is supported by the first and second support members 701 and 702.

Optional Accessories

At least one embodiment includes side extensions that expand the workstation surface area.

At least one embodiment includes an organizational insert may facilitate storage of craft/hobby items, external HD, CD, DVD, Jump drives, staplers, and papers.

As shown and described above in reference to FIGS. 9A-B, at least one embodiment includes a riser for monitors and/or laptops if used with auxiliary keyboard, LCD's.

At least one embodiment includes a foot rest to elevate one or the other foot while standing.

At least one embodiment includes reading stands to use while reading from an electronic reading device, such as an I-pad and Kindle. Such stands have application to use with printed material, such as a printed book or manual.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The one or more present inventions, in various embodiments, include components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, includes providing devices and processes in the absence of items not depicted and/or described herein or in various embodiments hereof, including in the absence of such items as may have been used in previous devices or processes (e.g., for improving performance, achieving ease and/or reducing cost of implementation).

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention (e.g., as may be within the skill and knowledge of those in the art, after understanding the present disclosure). It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A convertible workstation for adjusting between a sitting to a standing position, comprising:

a first horizontal panel having a top planar surface;

a drop-leaf panel hingedly attached to the first horizontal panel and convertible between a first position and a second position such that in the first position a primary planar surface of the drop-leaf panel is coplanar with the top planar surface of the first horizontal panel;

a first lateral member connected proximate a first lateral end of the first horizontal panel;

a second lateral member connected proximate a second lateral end of the first horizontal panel;

a rear panel stabilizer interconnecting the first lateral member to the second lateral member;

a first adjustable riser selectively interconnectable to the first lateral member, the first adjustable riser movable to adjust a vertical height of both the first lateral member and the first horizontal panel;

a second adjustable riser selectively interconnectable to the second lateral member, the second adjustable riser movable to adjust a vertical height of both the second lateral member and the first horizontal panel;

a first rotatable drop-leaf support panel hingedly attached to the first lateral member and moveable from a left outward position to a left inward position, wherein in the left outward position a first top support panel surface of the first rotatable drop-leaf support panel supports a left underside of the drop-leaf panel, and wherein a first stop bumper attached to the left underside of the drop-leaf panel limits outward rotation of the first rotatable drop-leaf support panel;

a second rotatable drop-leaf support panel hingedly attached to the second lateral member and moveable from a right outward position to a right inward position, wherein in the right outward position a second top support panel surface of the second rotatable drop-leaf support panel supports a right underside of the drop-leaf panel, and wherein a second stop bumper attached to the right underside of the drop-leaf panel limits outward rotation of the second rotatable drop-leaf support panel;

a third adjustable riser selectively interconnectable to the first rotatable drop-leaf support panel, the third adjustable riser movable to adjust a vertical height of both the first rotatable drop-leaf support panel and the drop-leaf panel; and a fourth adjustable riser selectively interconnectable to the second rotatable drop-leaf support panel, the fourth adjustable riser movable to adjust a vertical height of both the second rotatable drop-leaf support panel and the drop-leaf panel.

2. The convertible workstation of claim 1, wherein the first position can be changed to the second position in less than about 60 seconds.

3. The convertible workstation of claim 1, wherein the first position can be changed to the second position in between about 10 to 30 seconds.

4. The convertible workstation of claim 1, wherein the first adjustable riser is located laterally interior to the first lateral member, and wherein the second adjustable riser is located laterally interior to the second lateral member.

5. The convertible workstation of claim 1, further comprising a left side extension connected to the first lateral member, wherein a left side extension top surface of the left side extension is coplanar with the top planar surface of the first horizontal panel.

6. The convertible workstation of claim 1, further comprising a right side extension connected to the second lateral member, wherein a right side extension top surface of the right side extension is coplanar with the top planar surface of the first horizontal panel.

7. The convertible workstation of claim 1, further comprising a horizontal screen riser member vertically offset from the first horizontal panel, the horizontal screen riser member interconnected to the first horizontal panel by a first support member and a second support member.

8. The convertible workstation of claim 7, wherein the horizontal screen riser member extends beyond a back surface of the first horizontal panel.

* * * * *